US006708352B2

(12) United States Patent
Salvatini et al.

(10) Patent No.: US 6,708,352 B2
(45) Date of Patent: Mar. 23, 2004

(54) PATIENT SUPPORT APPARATUS AND METHOD

(75) Inventors: Benjamin Salvatini, Summerville, SC (US); Kenneth Ray Smith, Charleston, SC (US); John A. Brenner, Goose Creek, SC (US); Kerry Jean Mensching, Mt. Pleasant, SC (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 10/321,138

(22) Filed: Dec. 16, 2002

(65) Prior Publication Data

US 2003/0084511 A1 May 8, 2003

Related U.S. Application Data

(63) Continuation of application No. 09/604,208, filed on Jun. 27, 2000, and a continuation of application No. 09/551,266, filed on Apr. 18, 2000, now Pat. No. 6,493,888.

(51) Int. Cl.[7] ..... A47C 21/04; A47C 27/08; A61G 7/043

(52) U.S. Cl. ..... 5/423; 5/714; 5/691

(58) Field of Search ..... 5/423, 710, 713, 5/714, 715, 726, 652.2, 914, 691, 694

(56) References Cited

U.S. PATENT DOCUMENTS

| | | | | |
|---|---|---|---|---|
| 1,730,752 A | | 10/1929 | Withers | 5/706 |
| 1,772,310 A | | 8/1930 | Hart | 5/715 X |
| 2,604,641 A | | 7/1952 | Reed | 5/710 |
| 2,757,389 A | | 8/1956 | King | 5/496 |
| 3,083,379 A | | 4/1963 | Marinsky | 5/496 |
| 3,477,071 A | | 11/1969 | Emerson | 5/715 X |
| 3,485,240 A | | 12/1969 | Fountain | 601/148 |
| 3,513,489 A | | 5/1970 | Miller et al. | 5/945 X |
| 3,717,885 A | | 2/1973 | De Mare | 5/660 X |
| 3,772,717 A | | 11/1973 | Yuen et al. | 5/442 |
| 3,775,781 A | | 12/1973 | Bruno et al. | 5/715 X |
| 4,042,988 A | | 8/1977 | Holliday | 5/710 |
| 4,066,072 A | | 1/1978 | Cummins | 5/904 X |
| 4,151,618 A | | 5/1979 | Carpenter | 5/284 |
| 4,267,611 A | | 5/1981 | Agulnick | 5/713 |
| 4,336,621 A | | 6/1982 | Schwartz et al. | 5/658 |
| 4,347,633 A | * | 9/1982 | Gammons et al. | 5/713 |
| 4,454,615 A | | 6/1984 | Whitney | 5/691 |
| 4,472,847 A | * | 9/1984 | Gammons et al. | 5/713 |
| 4,485,505 A | * | 12/1984 | Paul | 5/714 |
| 4,525,885 A | | 7/1985 | Hunt et al. | 5/713 |
| 4,617,690 A | * | 10/1986 | Grebe | 5/713 |

(List continued on next page.)

FOREIGN PATENT DOCUMENTS

| | | | |
|---|---|---|---|
| DE | 3612362 A1 | 10/1987 | 5/423 |
| EP | 0 491 145 A1 | 10/1991 | |
| EP | 0 986 979 A1 | 9/1999 | |
| FR | 2 641 455 | 12/1988 | |
| GB | 1386249 | 3/1975 | 5/423 |
| WO | WO 86/02815 | 5/1986 | |
| WO | WO 96/33641 | 10/1986 | |
| WO | WO 87/004934 | 8/1987 | 5/904 |
| WO | WO 98/20828 | 5/1998 | |
| WO | WO 99/49761 | 10/1999 | |

*Primary Examiner*—Robert G. Santos
(74) *Attorney, Agent, or Firm*—Bose McKinney & Evans LLP

(57) ABSTRACT

A pediatric mattress that includes a sleep surface and a perimeter. The perimeter includes a cavity that is configured to receive the sleep surface. The perimeter also has at least one opening disposed into a chamber positioned within same. The opening is configured such that a gas may flow from the chamber through the opening and over the sleep surface. In addition, the pediatric mattress may include a percussion therapy system. The percussion therapy system includes an audio generator and at least one speaker. The speaker is connected to the audio-signal generator and is configured to produce and direct audio signals to the sleep surface.

31 Claims, 8 Drawing Sheets

U.S. PATENT DOCUMENTS 4,672,702 A 6/1987 Isham ..... 5/497
4,682,093 A 7/1987 Murphy ..... 5/239
4,697,290 A 10/1987 Alklind et al. ..... 5/632
4,706,313 A 11/1987 Murphy ..... 5/722
4,730,604 A 3/1988 Boggs ..... 601/55
4,905,332 A 3/1990 Wang ..... 5/710 X
4,934,002 A 6/1990 Watanabe ..... 5/715 X
4,944,060 A 7/1990 Peery et al. ..... 5/713
4,947,500 A 8/1990 Seiler ..... 5/706 X
4,949,412 A 8/1990 Goode ..... 5/713
4,977,629 A 12/1990 Jones ..... 5/715 X
5,022,110 A * 6/1991 Stroh ..... 5/710
5,027,454 A 7/1991 Peng ..... 5/706 X
5,063,912 A 11/1991 Hughes ..... 5/904 X
5,067,189 A 11/1991 Weedling et al. ..... 5/81.1 R
5,081,722 A 1/1992 Yu ..... 5/423 X
5,081,728 A 1/1992 Skinner ..... 5/727
5,092,007 A 3/1992 Hasty ..... 5/715
5,111,544 A 5/1992 Graebe ..... 5/654
5,142,720 A 9/1992 Kelso et al. ..... 5/715 X
5,168,589 A * 12/1992 Stroh et al. ..... 5/710
5,182,826 A 2/1993 Thomas et al. ..... 5/713
5,205,483 A 4/1993 Kostorz ..... 5/638
5,216,769 A 6/1993 Eakin ..... 5/904 X
5,301,457 A 4/1994 Seely ..... 5/423 X
5,313,679 A 5/1994 Yamaguchi ..... 5/659
5,317,767 A 6/1994 Hargest et al. ..... 5/423 X
5,375,273 A 12/1994 Bodine, Jr. et al. ..... 5/710
5,483,711 A 1/1996 Hargest et al. ..... 5/725
5,487,196 A * 1/1996 Wilkinson et al. ..... 5/715
5,513,402 A 5/1996 Schwartz ..... 5/691
5,553,339 A 9/1996 Thomas ..... 5/413 AM
5,568,663 A * 10/1996 Brown ..... 5/628
5,634,225 A 6/1997 Miller, Sr. et al. ..... 5/710
5,675,852 A 10/1997 Watkins ..... 5/726 X
5,699,569 A 12/1997 Schwarz-Zohrer ..... 5/655
5,729,853 A 3/1998 Thompson ..... 5/713
5,787,534 A 8/1998 Hargest et al. ..... 5/423 X
5,794,289 A 8/1998 Wortman et al. ..... 5/713
5,865,771 A 2/1999 Shuto et al. ..... 5/904 X
5,887,304 A 3/1999 von der Heyde ..... 5/423 X
5,890,245 A * 4/1999 Klearman et al. ..... 5/714
5,904,172 A 5/1999 Gifft et al. ..... 137/224
5,926,883 A 7/1999 Rechin et al. ..... 5/706
5,966,762 A 10/1999 Wu ..... 5/710
6,052,853 A 4/2000 Schmid ..... 5/423 X
6,055,690 A 5/2000 Koenig ..... 5/652.1 X
6,079,070 A * 6/2000 Flick ..... 5/715
6,131,216 A 10/2000 Pine ..... 5/93.1
6,145,142 A 11/2000 Rechin et al. ..... 5/706
6,336,237 B1 1/2002 Schmid ..... 5/715
6,370,716 B1 4/2002 Wilkinson ..... 5/715
6,370,718 B1 4/2002 Schmid ..... 5/726
6,493,888 B1 * 12/2002 Salvatini et al. ..... 5/423
6,499,166 B1 * 12/2002 Jones ..... 5/689
2001/0025391 A1 * 10/2001 Rabaiotti et al. ..... 5/710
2002/0133877 A1 * 9/2002 Kuiper et al. ..... 5/81.1 R
2003/0046762 A1 * 3/2003 Stolpmann ..... 5/421
2003/0084511 A1 * 5/2003 Salvatini et al. ..... 5/423
2003/0145380 A1 * 8/2003 Schmid ..... 5/423

* cited by examiner

PATIENT SUPPORT APPARATUS AND METHOD

RELATED PATENTS

This application is a continuation of U.S. application Ser. No. 09/551,266, filed on Apr. 18, 2000, now U.S. Pat. No. 6,493,888, and a continuation of U.S. application Ser. No. 09/604,208, filed on Jun. 27, 2000, the disclosures of which are incorporated herein by reference.

FIELD OF THE INVENTION

The present invention relates to a mattress. More particularly, the present invention relates to pediatric mattresses and mattresses for patient supports configured to support a patient positioned on a mattress.

BACKGROUND AND SUMMARY OF THE INVENTION

Patient supports are often used during treatment or recovery of a patient in a care facility. Patient supports typically includes a bedframe having a deck and a mattress positioned on the deck to support the patient.

Ventilated mattresses and percussion therapy are known in the art. Ventilating beds typically consist of a multi-chambered inflatable mattress that vents air through holes provided on its top surface. These holes allow air to escape while an air source continually supplies and maintains the desired amount of inflation to the mattress. This escaping air creates an environment that keeps a patient's skin cool, dry and comfortable.

The present invention provides percussion/audio therapy to a patient in combination with an inflatable air mattress. In addition, the present invention provides a bed that directs a gas and/or audio frequencies to the patient from a variety of directions.

According to the present invention, a mattress includes a sleep surface and a perimeter having a cavity configured to receive the sleep surface and at least one gas outlet located adjacent the cavity. The gas outlet is configured to be coupled to a gas supply to direct gas flow from the gas outlet over the sleep surface.

In one illustrated embodiment, the perimeter includes an inner wall defining the cavity. The perimeter is formed to include an internal chamber having at least one opening extending between the chamber and the inner wall to define the at least one gas outlet. The chamber is configured to be coupled to the gas supply so that the gas is directed through the chamber and the at least one opening and over the sleep surface. Illustratively, the sleep surface is configured to be coupled to the inner wall of the perimeter at a location below the at least one opening.

Also in an illustrated embodiment, a spacer is located within the cavity. The spacer is configured to define first and second bladder cavities. First and second bladders are located in the first and second bladder cavities, respectively, for supporting the sleep surface. The first and second bladders are configured to be selectively inflated and deflated to provide rotational therapy to a patient on the sleep surface.

Also according to the present invention, a mattress includes a sleep surface, a perimeter having a cavity configured to receive the sleep surface, and at least one speaker positioned adjacent the sleep surface. The speaker is configured to direct a desired therapy wave signal to the sleep surface. In the illustrated embodiment, the mattress also includes an audio signal generator coupled to the at least one speaker to supply percussion/vibration therapy to a patient or to play music to be heard by the patient on the sleep surface.

According to the present invention, a mattress is provided for use on a deck of a bed. The mattress includes a sleep surface or cover, a first cushion, and a second cushion. The cover includes a side wall defining an interior region of the cover. The first cushion is integral with the side wall of the cover and the second cushion is positioned in the interior region of the cover.

According to preferred embodiments of the present invention, the mattress further includes an inner wall and the cover includes an outer wall coupled to the inner wall to define the first cushion which is inflatable. The outer wall of the cover includes an opening configured to receive the second cushion to permit a caregiver to insert the second cushion through the opening into the interior region of the cover. The mattress further includes a fastener that extends through the opening to couple the second cushion to the deck of the bed. The second cushion includes a layer of three dimensional engineered material.

Additional features of the invention will become apparent to those skilled in the art upon consideration of the following detailed description exemplifying the best mode of carrying out the invention as presently perceived.

BRIEF DESCRIPTION OF THE DRAWINGS

The present invention will be described with reference to the attached drawings which are given as non-limiting examples only, in which.

Corresponding reference characters indicate corresponding parts throughout the several views. The drawings set out herein are illustrative embodiments of the invention, and such embodiments are not to be construed as limiting the scope of the invention.

DETAILED DESCRIPTION OF EMBODIMENTS OF THE INVENTION

The present invention relates to a mattress. In one embodiment, the present invention relates to a pediatric air mattress. The pediatric mattress is of any conventional size to fit on a variety of cribs and/or child beds. In one embodiment, the mattress is configured to provide a cross air flow over a sleep surface of the mattress. In addition, the sleep surface itself is a low-air-loss surface providing air flow directed from the surface to the patient. It is appreciated that the mattress herein described, may be used for any variety of applications beyond just as a pediatric mattress. A low-air-loss mattress allows air to escape from its surface underneath the patient. This creates a drier environment under the patient helping to prevent maceration which is one causative factor in pressure ulcer development. In one embodiment of the present invention, the mattress is configured to include a percussion therapy system to assist in pulmonary cleansing and comfort. The audio or sound resulting from the percussion therapy system is directed through the sleep surface to the patient. Alternatively, the sound is directed into the cross air flow and over the sleep surface to the patient. In this embodiment, the percussion therapy system is integrated into the mattress.

Figure 1:
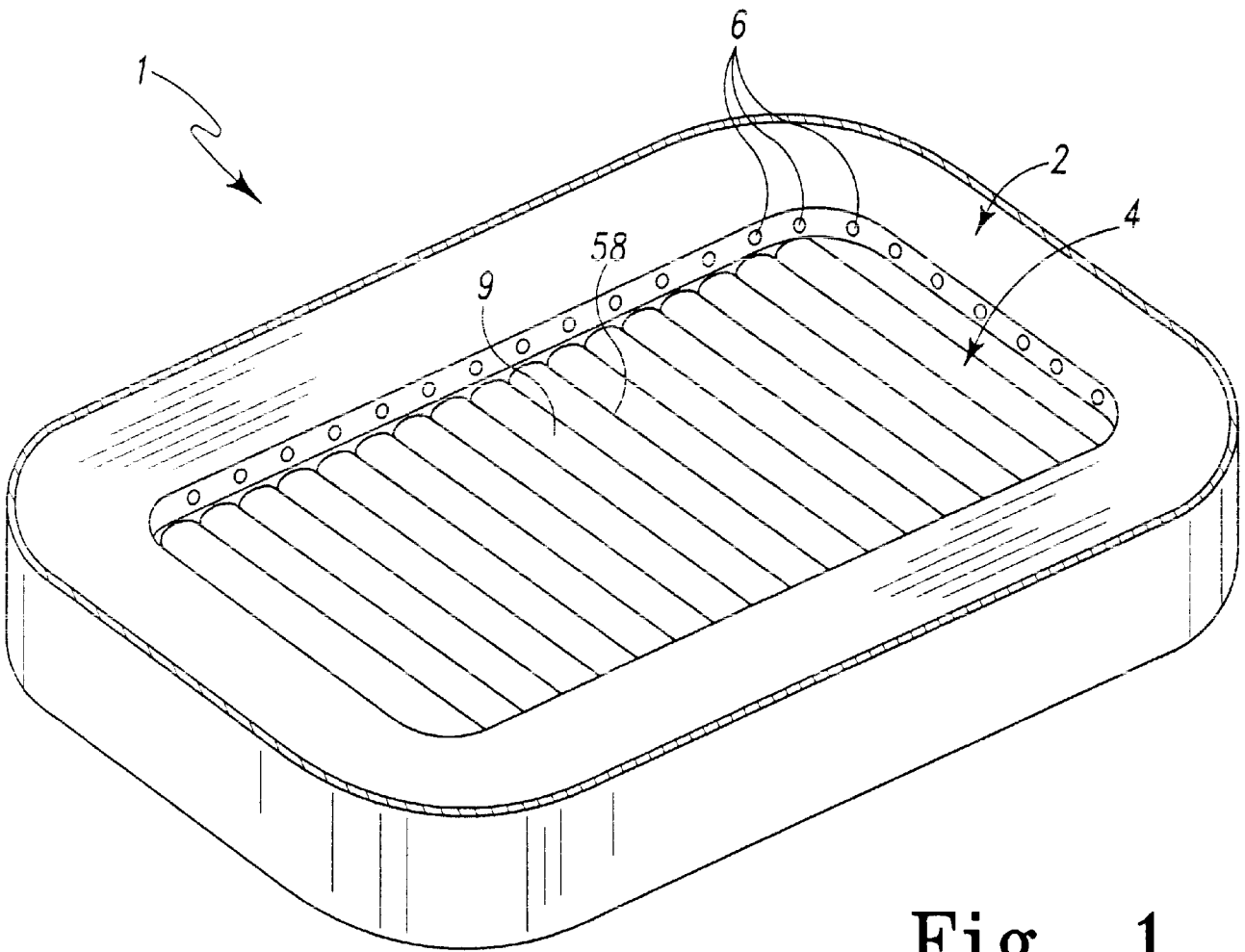
FIG. 1 is a perspective view of a pediatric mattress according to one embodiment of the present invention.

A pediatric mattress according to one embodiment of the present invention is shown in FIG. 1. Mattress 1 comprises a body having a perimeter 2 forming the border structure of mattress 1. A sleep surface 4 is fitted within perimeter 2. Sleep surface 4 is illustratively an inflatable bed and the portion of mattress 1 that supports a patient 5. (See FIG. 3.) In the illustrated embodiment, a plurality of air holes 6 are positioned in perimeter 2 above sleep surface 4. Holes 6 are configured to direct air flow and/or audio frequencies over sleep surface 4 to patient 5. It is appreciated that any number of holes can be used to create the air flow or the cross air flow. The cross air flow direction is indicated by reference number 32 in FIG. 3.

Figure 2:
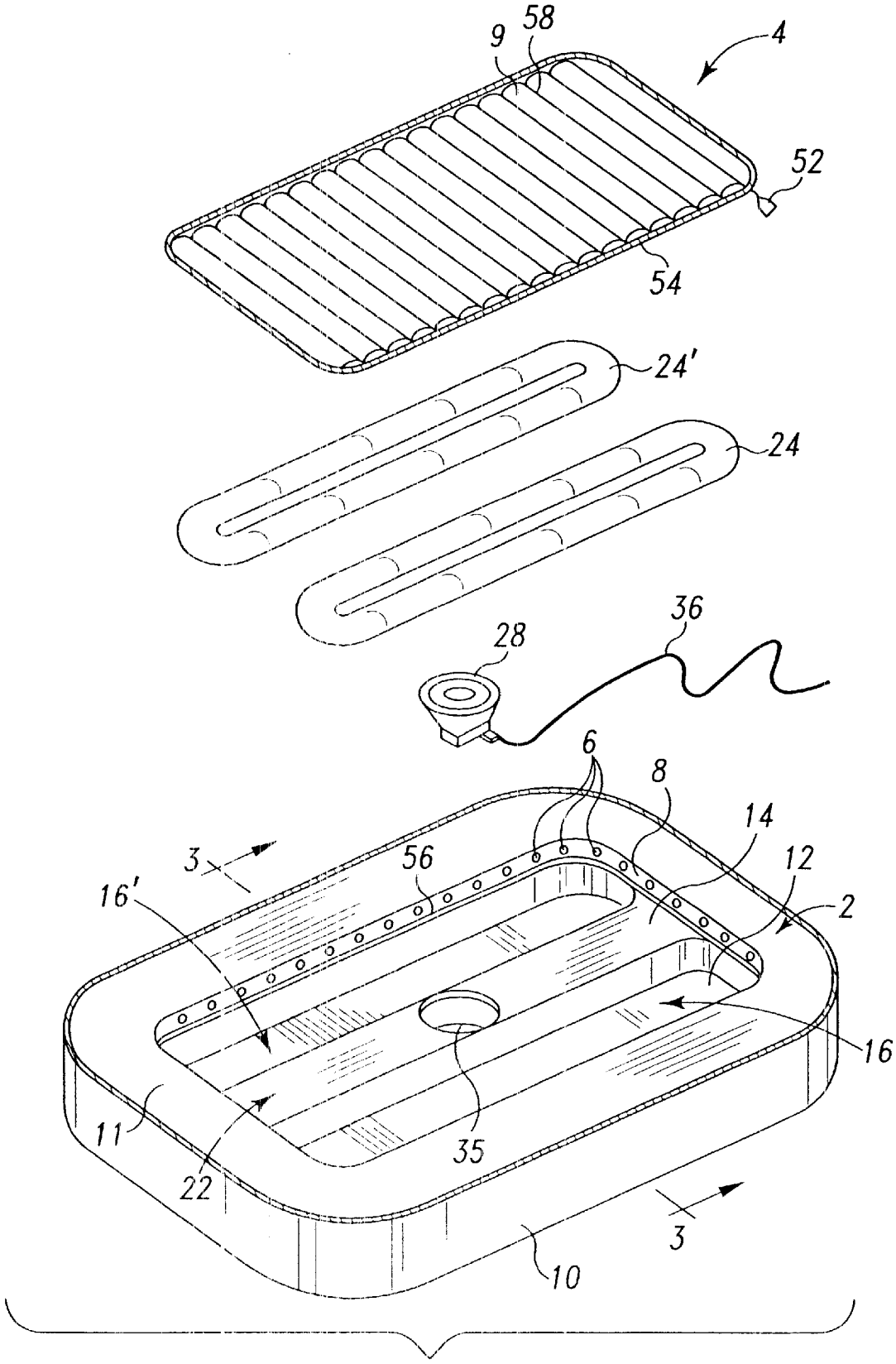
FIG. 2 is an exploded perspective view of the pediatric mattress of FIG. 1.
Figure 3:
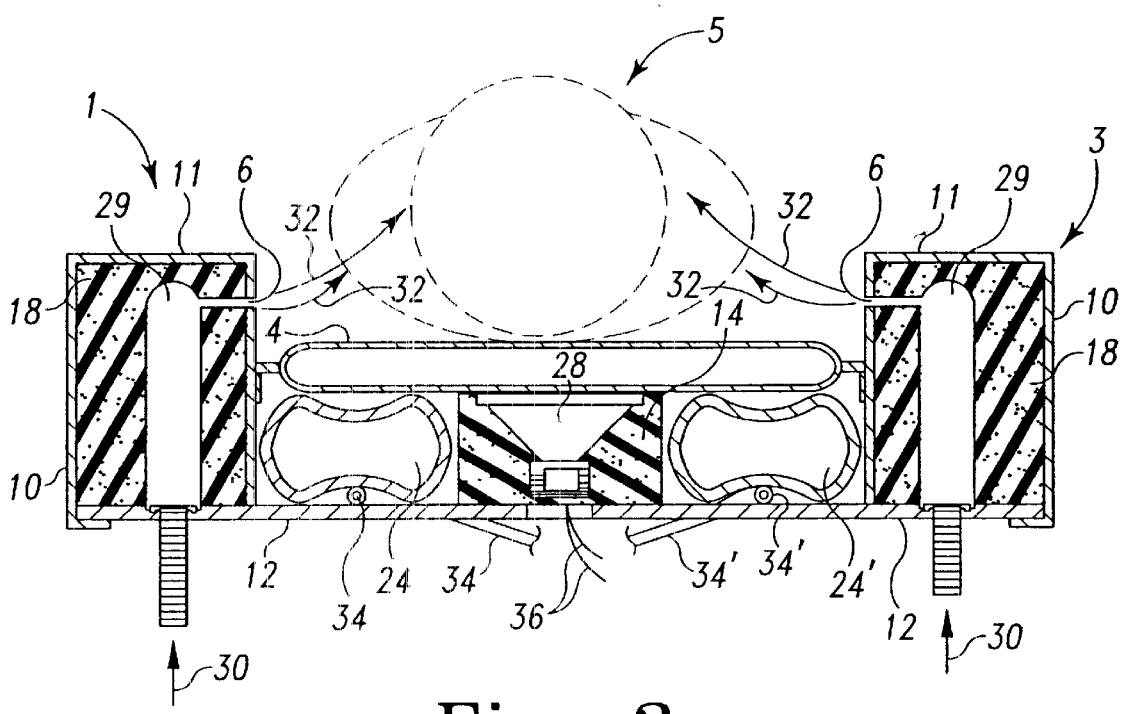
FIG. 3 is a cross sectional end view taken along line 3—3 of FIG. 2.

An exploded view of mattress 1 is shown in FIG. 2. In the illustrated embodiment, perimeter 2 comprises an inner periphery wall 8, an outer periphery wall 10, a deck 11, a base 12, a spacer 14, and bladder cavities 16 and 16'. Inner periphery wall 8 extends upwardly from base 12 and is generally complimentary to the outer shape of sleep surface 4. Outer periphery wall 10 forms the outer boundary of perimeter 2 and is illustratively sized and configured to fit any conventional crib or support. Deck 11 is a top surface extending between the inner and outer periphery walls 8 and 10. A core 18 illustratively provides the body of perimeter 2, as shown in FIG. 3. Core 18 is made from a suitable material such as foam, rubber or other material. It is appreciated, however, that core 18 may be replaced by an inflatable body if desired.

Core 18 is positioned on base 12 that supports pediatric mattress 1. Base 12 spans the area of mattress 1 and is made of any suitable material such as metal, wood, or plastic. Perimeter 2 forms a sleep surface cavity 22. In the illustrative embodiment spacer 14 is positioned within cavity 22 and extends lengthwise therein. Spacer 14 serves several purposes including adding structural support to perimeter 2, separating bladders 24 and 24' and serving as a receptacle for speaker 28 from the percussion therapy system discussed in further detail herein. The spacer 14 is illustratively made from the same materials as core 18. In the illustrated embodiment, spacer 14 separates cavity 22 into first and second bladder cavities 16 and 16'. Bladder cavities 16 and 16' are configured to receive first and second bladders 24 and 24', respectively, as best shown in FIG. 3.

Cross air flow is created by passing air over sleep surface 4. To accomplish this, holes 6 are disposed through inner periphery wall 8. Each hole 6 extends through core 18 into air chamber 29, as best shown in FIG. 3. In one embodiment air chamber 29 is provided within the entire perimeter body 2. (See FIG. 3) Supply tube 30, supplies air from an air source to chamber 29 which is then expelled through air holes 6 as indicated by air directional flow arrows 32. Illustratively, multiple air tubes 30 may be used and be transversely positioned to create an even cross flow of air over sleep surface 4.

In the illustrated embodiment, spacer 14 partitions cavity 22 into first and second bladder cavities 16 and 16' as previously discussed. First and second inflatable bladders 24 and 24' are configured to be received in cavities 16 and 16', respectively, and support sleep surface 4. Illustratively, bladders 24 and 24' are filled with a gas to provide the necessary support. Supply tubes 34 and 34' deliver air to bladders 24 and 24', respectively, to either fill, maintain, or change the level of support. It will be appreciated that any number of bladders may be used to support sleep surface 4. This includes providing one or more bladders that fill the entire area of sleep cavity 20. It is also appreciated that bladders 24 and 24' may be filled with substances other than air. Bladders 24 and 24' may be filled with a foam, gel, or even particulates. Bladders 24 and 24' are illustratively configured to be held loosely in cavities 16 and 16', respectively. In another embodiment, the bladders 24 and 24' are fastened into cavities 16 and 16' by any conventional means including Velcro, zippers or an adhesive.

In the illustrated embodiment, a speaker receptacle 35 is formed at a central location along spacer 14. Receptacle 35 is configured to receive and position a speaker 28 so that the speaker 28 directs audio to patient 5. (see FIG. 3.) It will be appreciated that speaker 28 may be a plurality of speakers positioned anywhere along spacer 14, periphery wall 8, and bladder cavity 16 and/or 16'. In addition, the speaker 28 may be positioned and configured such that it directs an audio-frequency through air holes 6 to sleep surface 4. In one illustrative embodiment, speaker 28 is connected to an audio-frequency generator (not shown) via speaker wire 36. Wire 36 is configured to allow the audio-frequency generator be either an integral part of mattress 1 or a separate unit. It is appreciated that the audio-frequency generator may be of any conventional type including, but not limited to, a digital audio signal generator, a compact disc or cassette tape player, or a phonograph.

Sleep surface 4 in the illustrated embodiment is positioned within cavity 20 and placed over top of bladders 24, 24' and spacer 14. As shown in FIG. 3, the weight of patient 5 lying on sleep surface 4 creates a downward force that may compress bladders 24 and 24'. Mattress 1 is configured such that bladders 24 and 24' compress to a point substantially adjacent spacer 14. It is appreciated, however, that sleep surface 4 does not have to be positioned adjacent speaker 28 for same to work properly. In another illustrative embodiment, sleep surface 4 includes a zipper 52 and zipper teeth 54 attached at its outer periphery, with corresponding zipper teeth 56 attached to inner wall 8, as shown in FIG. 2. This arrangement allows sleep surface 4 to be secured to mattress 1, yet be easily removed to allow sleep surface 4 to be replaced or to gain access to bladders 24, 24' and/or speaker 28. It is appreciated that sleep surface 4 may be attached to mattress 1 by any conventional means including, but not limited to, Velcro, ties, or an adhesive. The sleep surface 4 itself is illustratively an air filled bladder, a multi-chambered bladder, or a series bladders.

Sleep surface 4 in FIGS. 1, 2, 5 and 6 is shown as multi-chambered bladders having a corrugated design 58. It is appreciated that sleep surface 4 may be of any conventional design. Illustratively, sleep surface 4 is a low-air-loss sleep surface. In this embodiment, a plurality of holes (not shown), illustratively about 30 microns in diameter, are disposed through at least one side of said surface, typically the top surface 9. Air is thus allowed to slowly escape sleep surface 4 creating a zone of moving air about the patient. An inflator (not shown) is coupled to sleep surface 4 to replenish the lost air and to adjust the firmness of the surface. In addition, speaker 28 may be positioned to direct sound through said holes to patient 5 to assist the percussion therapy.

In the illustrated embodiment, air is alternately supplied to and removed from bladders 24 and 24' to provide rotational therapy to the patient on the sleep surface 4. Illustratively, sleep surface 4 may be unzipped from the perimeter 2 and disposed of after each use. This eliminates the need to sanitize the sleep surface 4 after each use. Speaker 28 provides percussion/vibration therapy to the patient on the sleep surface 4. In addition, music may be played through the speaker 28. This eliminates the need for separate accessory equipment to provide rhythmic sounds for comfort and stimulation of the patient.

Figure 4:
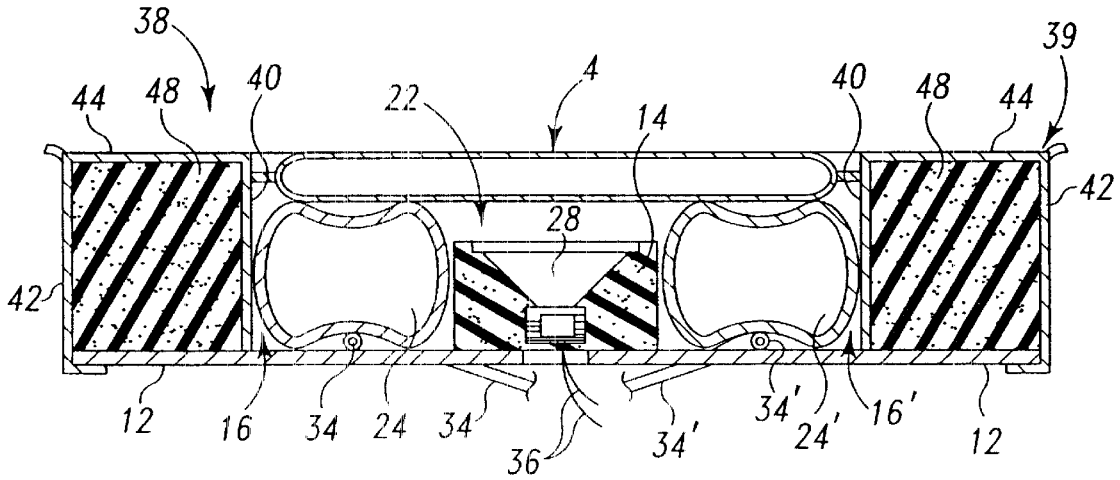
FIG. 4 is a sectional view of another embodiment of the pediatric mattress according to the present invention.

Another embodiment of the present invention is shown in FIG. 4. Pediatric mattress 38, according to this embodiment, comprises a perimeter 39 that forms the outer body of mattress 38. A sleep surface 4 is fitted in perimeter 39. In this illustrated embodiment, perimeter 39 is a border structure comprising an inner periphery wall 40, an outer periphery wall 42, a deck 44, and a base 12, as well as a spacer 14, and bladder cavities 16 and 16' similar to the previous embodiment. This embodiment, however, differs from the previous embodiment in that there are no gas holes disposed through inner periphery wall 40 and no channel provided within core 48. Inner periphery wall 40 extends upwardly from base 12 and is generally the shape of sleep surface 4. Outer periphery wall 42 forms the outer boundary of perimeter 39 and can be illustratively sized and configured to fit any conventional crib or support, like the previous embodiment. Deck 44 includes an upper surface that is formed parallel to sleep surface 4 and positioned adjacent both inner and outer periphery walls 40 and 42. Inner periphery wall 40, outer periphery wall 42 and deck 44 maintain their shape by being formed over a core 48 that is the shape of perimeter 39. As with core 18, core 48 is made from any suitable material such as foam, rubber or other material.

Core 48 is positioned on base 12 that supports pediatric mattress 38. Illustratively, base 12 spans the area of mattress 38 and is made of any suitable material, such as metal, wood, or plastic. Perimeter 39 forms a sleep surface cavity 22, similar to the previous embodiment. Spacer 14 is illustratively positioned within cavity 22 and extends lengthwise therein. As with the previous embodiment, spacer 14 also serves several purposes, including adding structural support to perimeter 14, separating bladders 24 and 24', and serving as a receptacle for speaker 28 from the percussion therapy system. Like the previous embodiment, it will be appreciated that spacer 14 is illustratively made from the same material as core 18. In the illustrated embodiment, spacer 14 separates cavity 22 into first and second bladder cavities 16 and 16'. Bladder cavities 16 and 16' are configured to receive first and second bladders 24 and 24', as best shown in FIG. 4.

Figure 5:
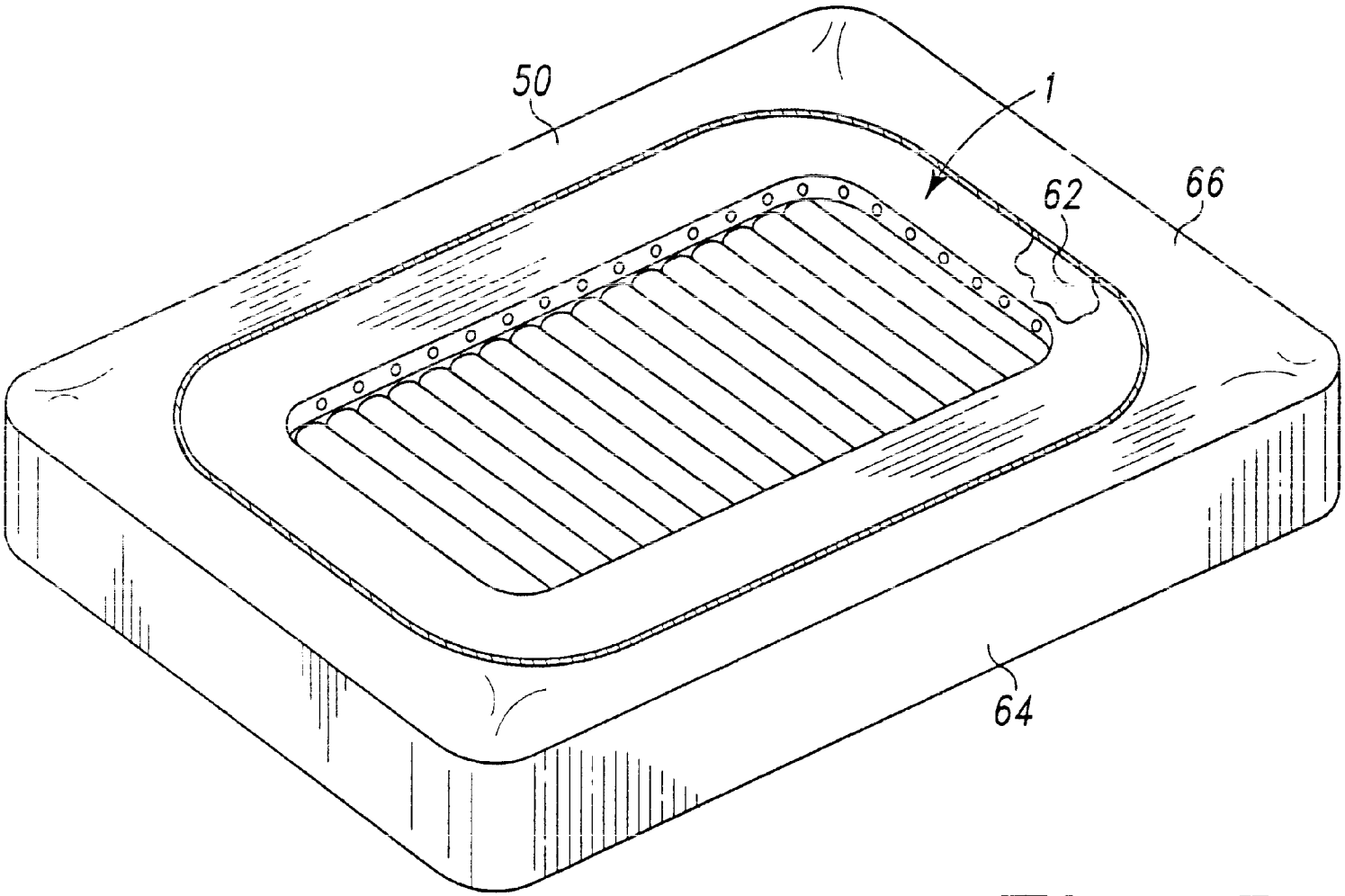
FIG. 5 is a perspective view of the pediatric mattress according to a further embodiment of the present invention.
Figure 6:
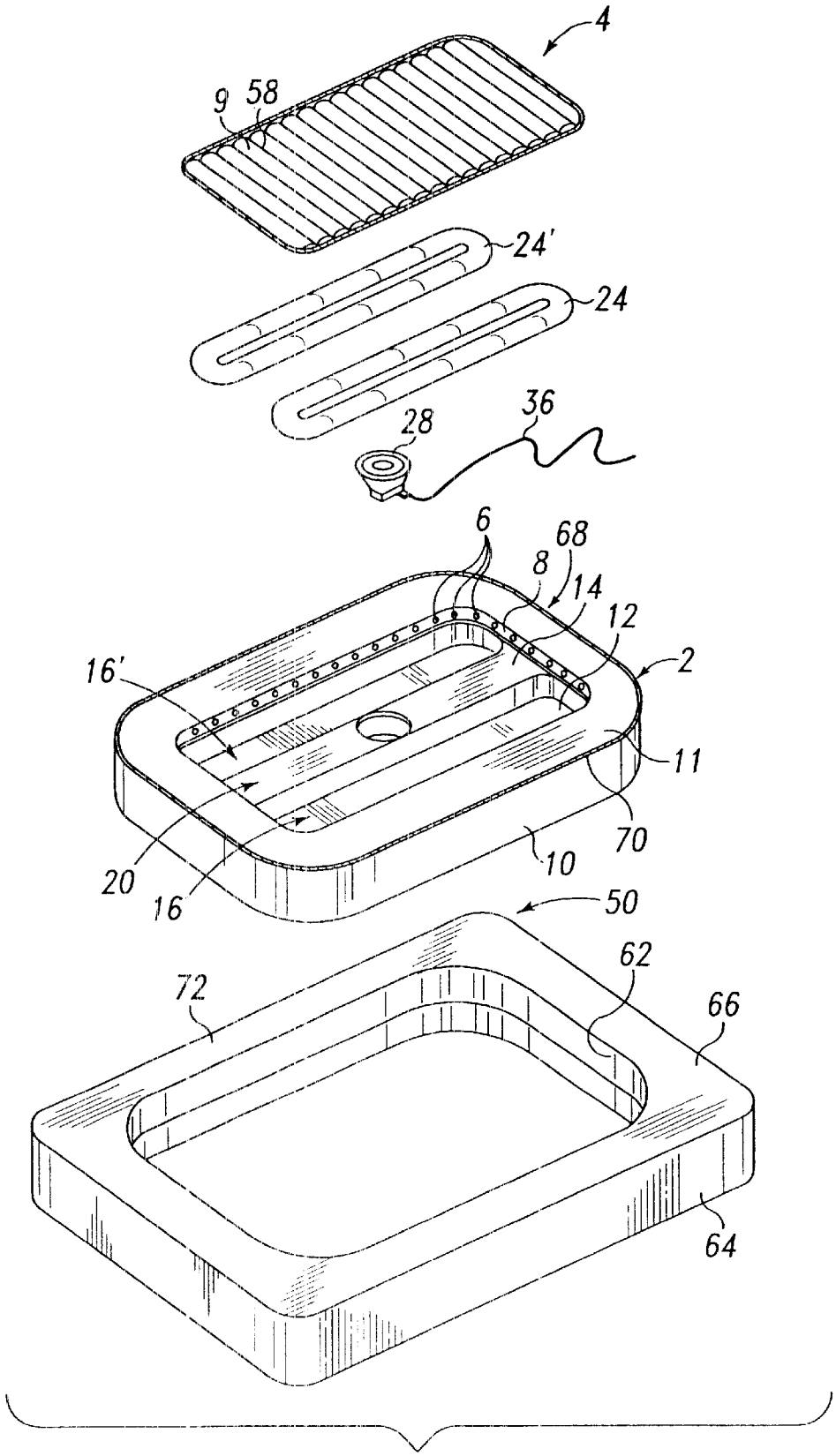
FIG. 6 is an exploded perspective view of the pediatric mattress of FIG. 5.

A further embodiment of the present invention includes a pediatric mattress fitted within a border 50, as shown in FIGS. 5 and 6. Illustratively, either mattress 1 or 38 can be configured to fit within border 50. Border 50 is itself configured to provide additional length and/or width to either mattress 1 or 38 to allow the mattress to be fitted in a larger crib or a larger bed frame. Illustratively, border 50 comprises an inner wall 62, an outer wall 64, and a top surface 66 extending between adjacent inner and outer walls 62 and 64. A core (not shown) provides the body structure for border 50 similar to cores 18 and 46 as shown in FIGS. 3 and 4, respectively. The core of border 50 is illustratively made from the same type of material as cores 18 and 46. In the illustrated embodiment, perimeter 2 includes a zipper 68 and zipper teeth 70 attached at its outer periphery, with corresponding zipper teeth 72 attached to inner wall 66, as shown in FIG. 6. This arrangement allows perimeter 2 to be secured to border 50. It will be appreciated that perimeter 2 may be attached to border 50 by any conventional means including, but not limited to, Velcro, ties, or an adhesive. In addition, the border 50 may simply be placed over the perimeter 2 without any fasteners.

Illustratively, perimeter 2 is fitted into border 50 such that deck 11 is positioned in substantially the same plane as top surface 66, as shown in FIG. 5. In the illustrated embodiment, zipper teeth 70 are provided adjacent deck 11 and outer wall 10, and zipper teeth 72 are provided about inner wall 62. The vertically oriented positioning of zipper teeth 72 determines the relative difference in height, if any, between deck 11 and top surface deck 66.

Figure 7:
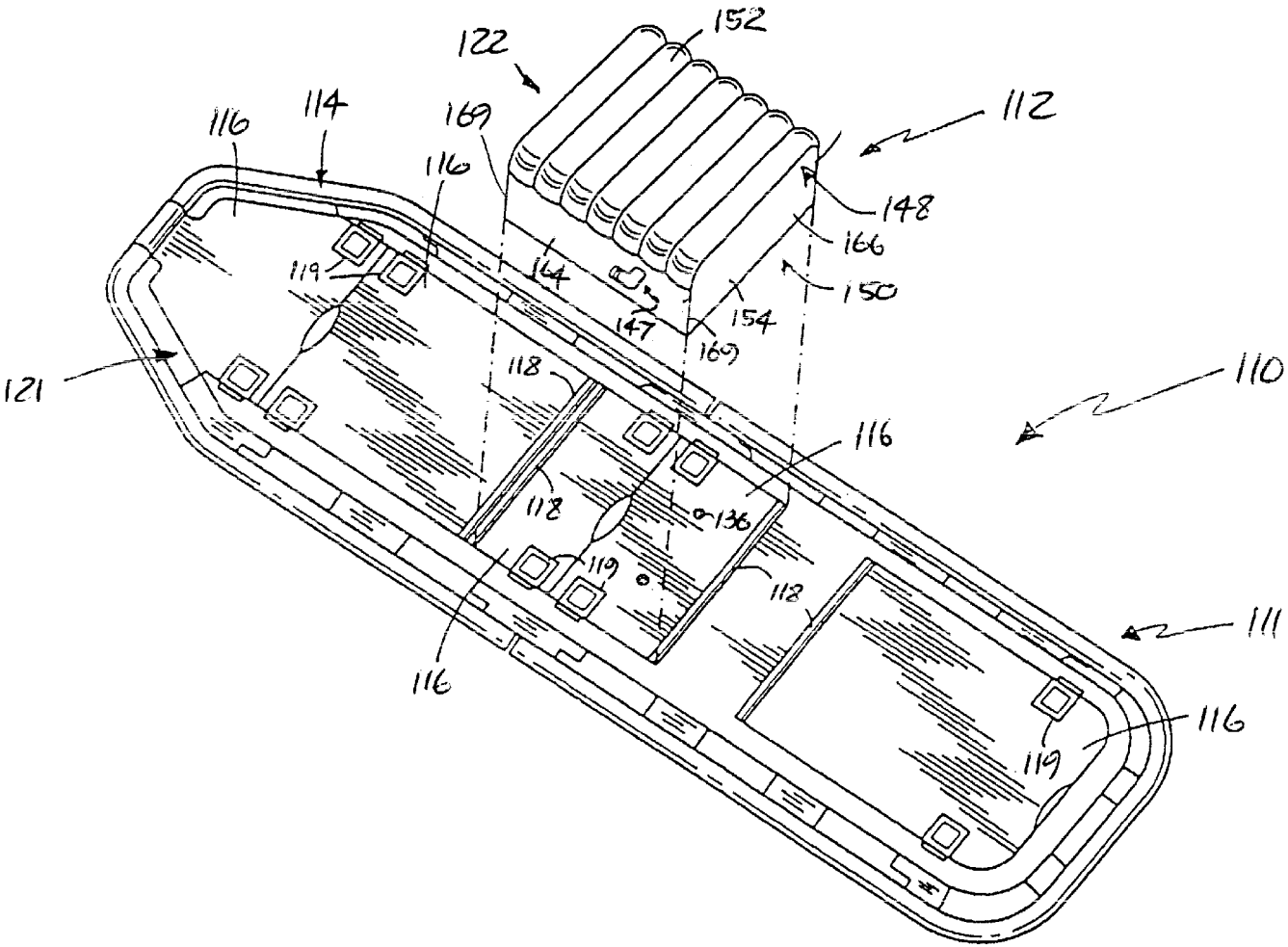
FIG. 7 is a perspective view of a stretcher for use with a proning bed having a perimeter frame, a multi-panel deck, and a disposable mattress section.

According to another embodiment of the invention, a portable bed or stretcher 110 is shown in FIG. 7. Stretcher 110 includes a mattress support section 111 and a disposable mattress section 112 positioned over mattress support section 111 so that mattress section 112 can be coupled to mattress support section 111 of stretcher 110 by a care provider. After use, a disposable portion of mattress section 112 is discarded and other portion of mattress section 112 is reused with a new disposable portion.

Stretcher 110 may be coupled to a proning bed (not shown). The proning bed rotates the stretcher 110 and the patient positioned thereon so that the patient is moved between upwardly and downwardly facing positions or any position therebetween. Mattress support section 111 includes a perimeter frame 114 and a series of panels 116 pivotally coupled to perimeter frame 114 by a series of hinges 118 and latches 119 to define a deck 121. When the patient is in the downwardly facing position, one or more of panels 116 may then be opened by moving the respective latches 119 and by moving panels 116 about their respective hinges 118. Opening the panels 116 permits access to the patient's back without removing stretcher 110 from its position on top of the patient. A description of a suitable proning bed is provided in PCT Application No. PCT/US99/14525, the disclosure of which is expressly incorporated by reference herein. Mattress section 112 may also be used with other bed configurations.

Figure 8:
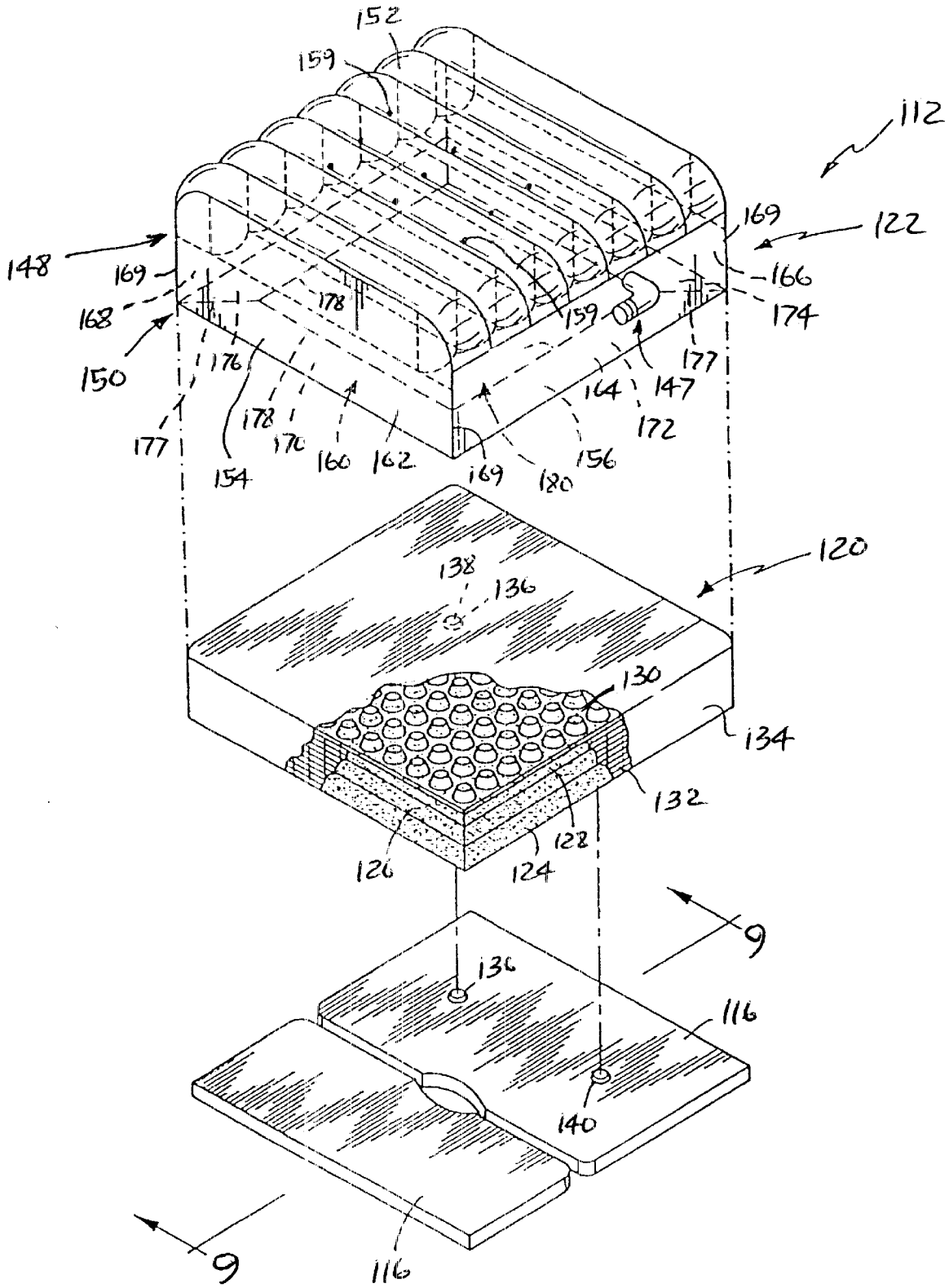
FIG. 8 is an exploded view of the mattress section of FIG. 1 showing the mattress section including a lower cushion positioned over two panels of the deck and an upper mattress positioned over the lower cushion.
Figure 9:
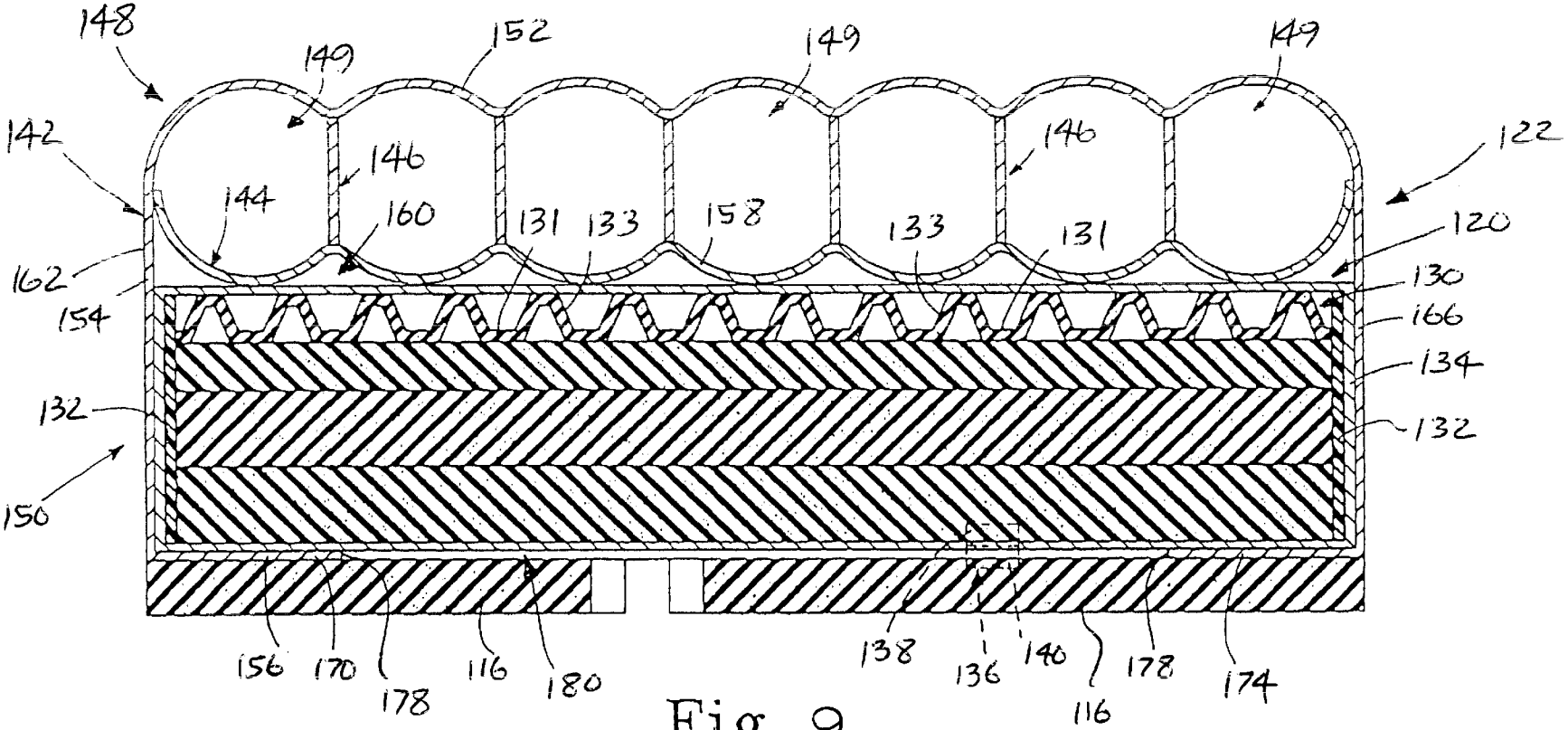
FIG. 9 is a cross-sectional view taken along lines 9—9 of FIG. 8 showing the lower cushion positioned.

Stretcher 110 further includes additional mattress sections (not shown) similar to mattress section 112 so that stretcher 110 provides a resilient support surface for a person positioned on stretcher 110. As shown in FIG. 8, mattress section 112 includes a lower reusable mattress portion or cushion 120 and an upper disposable mattress portion or sleep surface 122 that is positioned over lower cushion 120. As shown in FIG. 9, sleep surface 122 covers around lower cushion 120 so that sleep surface 122 covers lower cushion 120. According to the presently preferred embodiment of the present disclosure, sleep surface 122 is inflatable. According to alternative embodiments of the disclosure, sleep surface 122 includes foam or another resilient material.

Before mattress section 112 is coupled to panel 116, sleep surface 122 is wrapped around lower cushion 120. Mattress section 112 is then coupled to panel 116 to provide support for a patient positioned therein. After the patient is removed from stretcher 110, mattress section 112 is removed from panel 116 and lower cushion 120 is removed from within sleep surface 122. Sleep surface 122 is then disposed. However, lower cushion 120 is retained and cleaned and a substantially identical sleep surface 122 is positioned over lower cushion 120 so that mattress section 112 can be used for the next patient.

To position mattress section 112 on panels 116, a care provider first positions lower cushion 120 within sleep surface 122. After lower cushion 120 is securely positioned in sleep surface 122, a pair of fasteners 136 coupled to both lower cushion 120 and panel 116 are snapped together. Because lower cushion 120 is now secured to panel 116 and sleep surface 122 is wrapped around lower cushion 120, sleep surface 122 is secured to mattress section support 111.

As shown in FIGS. 8–9, lower cushion 120 includes a bottom layer of foam 124, an intermediate layer of foam 126, and a top layer of foam 128 positioned on top of intermediate layer of foam 126. The stiffness or ILD of layers 124, 126, 128 increases from top to bottom so that top layer 128 is the softest layer of foam and bottom layer of foam 124 is the stiffest layer of foam. Thus, lower cushion 120 has a stiffness gradient that increases with its depth.

Lower cushion 120 further includes a layer of three-dimensional engineered material 130 positioned on top of top layer of foam 128. Layer of engineered material 130 is made of a fiber network formed to include a base 131 and a plurality of resilient hollow projections 133 shaped as truncated cones as shown, for example, in FIG. 9. Further description of a suitable three-dimensional engineered material is provided in U.S. Pat. No. 5,731,062, issued Mar. 24, 1998 to Kim et al. and U.S. Pat. No. 6,269,504, issued Aug. 7, 2001 to Romano et al., the disclosures of which are expressly incorporated by reference herein. Lower cushion 120 further includes a layer of fireguard 132 extending around the perimeter of bottom, intermediate, and top layers of foam 124, 126, 128 and layer of engineered material 130 as shown, for example, in FIG. 8.

Lower cushion 120 also includes a wipable ticking material 134 that covers bottom, intermediate, and top layers of foam 124, 126, 128, layer of engineered material 130, and fireguard 132 as shown for example in FIGS. 8–9. After each use, ticking material 134 is cleaned by a care giver so that it is sanitized for its next use.

Each fastener 136 is preferably a snap and includes an upper portion 138 coupled to ticking material 134 of lower cushion 120 and a lower portion 140 coupled to panel 116. To couple lower cushion 120 to panel 116, a user snaps upper portions 138 of fasteners 136 to lower portions 140 of fasteners 136 as shown, for example, in FIG. 9.

As shown in FIG. 9, sleep surface 122 includes an outer wall 142, an inner wall 144, a plurality of baffles 146 that extend between inner and outer walls 142, 144, and a nozzle 147 coupled to outer wall 142. The perimeter of inner wall 144 is welded to outer wall 142 to define a bladder or upper cushion 148. When inflated, bladder 148 provides support for a person positioned on mattress section 112. Bladder 148 is inflated using a source of pressurized air (not shown) coupled to nozzle 147. Bladder 148 may be inflated before or after the insertion of lower cushion 120 into sleep surface 122. Top wall 152 includes a series of microvents 159 that permit a predetermined amount of air to leak out of bladder 148 so that bladder 148 is a low air loss bladder. Preferably, top wall 152 includes twelve microvents 159 having a diameter of 0.030 inches when sleep surface 122 is inflated to a pressure ranging from 0–18 inches of water.

According to the preferred embodiment, six baffles 146 define seven pockets 149 in bladder 148. According to alternative embodiments, fewer or more baffles are provided to divide the bladder into fewer or more pockets. According to the presently preferred embodiment of the present disclosure, baffles 146 and inner wall 144 are made of a 5 millimeter urethane material.

Outer wall 142 also provides a cover 150 that partially surrounds lower cushion 120 as shown in FIG. 9. Outer wall 142 includes a top wall 152 welded to each baffle 146, a perimeter side wall 154 integral with top wall 152, and a bottom wall 156 integral with side wall 154 as shown, for example, in FIG. 9. Top, side, and bottom walls 152, 154, 156 define an interior region 160 of cover 150 in which lower cushion 128 is positioned during use of mattress section 112. Bladder 148 also includes top wall 152 and a bottom wall 158 welded to top wall 152. Thus, bladder 148 and cover 150 share common top wall 152.

Side wall 154 includes first, second, third, and fourth panels 162, 164, 166, 168. First and third panels 162, 166 are integral with top wall 152 and bottom wall 156, as shown for example in FIG. 9. Second and fourth panels 164, 168 are welded to top wall 152 and are also integral with bottom wall 156. Second and fourth panels 164, 168 also weld to first and third panels 162, 166 to define corners 169 of sidewall 154.

Bottom wall 156 of cover 150 includes first, second, third, and fourth flaps 170, 172, 174, 176. First and third flaps 170, 174 are integral with respective first and third panels 162, 166 as shown in FIG. 9. Second and fourth flaps 172, 176 are integral with respective second and fourth panels 164, 168. Second and fourth flaps 172, 176 are welded to first and third flaps 170, 174 to define corner seams 177 of bottom wall 156. Thus, in the illustrated embodiment, first flap 170, first panel 162, top wall 152, third panel 166, and third flap 174 are formed from a uniform piece of material. According to the presently preferred embodiment, this material is made of a non-woven plastics material having a cotton-like feel sold under the brand name Securon.

First, second, third, and fourth flaps 170, 172, 174, 176 each include an edge 178 defining an opening 180 in bottom wall 146. Fasteners 136 are spaced apart from edges 178 and extend through opening 180 to couple lower cushion 120 to deck panel 116. A caregiver slides lower cushion 120 through opening 180 to insert lower cushion 120 into sleep surface 122. Similarly, lower cushion 120 is removed from sleep surface 122 by pulling lower cushion through opening 180. Thus, sleep surface 122 provides a combination inflatable cushion and cover that provides support to a patient positioned thereon and protection to lower cushion 120 and is disposable. Lower cushion 120 provides a reusable patient support.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as set forth in the following claims.

What is claimed is:

1. A method of providing a sanitary mattress, including the steps of:

providing a mattress body;

coupling a low-air-loss sleep surface to the mattress body, the sleep surface including a first bladder and a second bladder coupled to the first bladder;

decoupling the sleep surface from the mattress body after use;

discarding the sleep surface; and coupling a second low-air-loss sleep surface to the mattress body after completing the decoupling step.

2. The method of claim 1, wherein the mattress body includes a cavity for receiving the sleep surface.

3. The method of claim 1, wherein the mattress body includes a gas outlet to direct gas flow over the sleep surface.

4. The method of claim 1, wherein the mattress body includes a perimeter, the sleep surface being coupled to and decoupled from the perimeter.

5. The method of claim 1, wherein the coupling step includes the step of forming a substantially continuous connection between a periphery of the sleep surface and the mattress body.

6. The method of claim 1, wherein the sleep surface includes a plurality of holes configured to permit gas flow through a surface of the sleep surface.

7. The method of claim 1, wherein the mattress body includes a coupler and the coupling step is performed using the coupler.

8. A method of providing a sanitary mattress, including the steps of:

providing a mattress body including a cavity for receiving a low-air-loss sleep surface;

installing a bladder in the cavity to support the sleep surface;

coupling the low-air-loss sleep surface to the mattress body;

decoupling the sleep surface from the mattress body after use; and discarding the sleep surface.

9. The method of claim 8, wherein the mattress body includes a coupler and the coupling step is performed using the coupler.

10. A method of providing a sanitary mattress, including the steps of:

providing a mattress body including a cavity for receiving a low-air-loss sleep surface;

coupling the low-air-loss sleep surface to the mattress body;

decoupling the sleep surface from the mattress body after use;

discarding the sleep surface; and installing at least two bladders in the cavity to support the sleep surface.

11. The method of claim 10, the bladders are configured to be selectively inflated and deflated to provide rotational therapy to a patient on the sleep surface.

12. The method of claim 10, wherein the coupling step includes the use of an attachment means.

13. A method of providing a sanitary mattress, including the steps of:

providing a mattress body;

coupling a low-air-loss sleep surface to the mattress body, the coupling step including the step of attaching the sleep surface to the mattress body at a location below an opening formed in the mattress body for directing gas flow over the sleep surface;

decoupling the sleep surface from the mattress body after use; and discarding the sleep surface.

14. The method of claim 13, wherein the coupling step includes the use of an attachment means.

15. A method of providing a disposable mattress, including the steps of:

coupling a first sleep surface to a perimeter of a mattress, the sleep surface including a first bladder and a second bladder coupled to the first bladder;

permitting a person to contact the first sleep surface;

decoupling the first sleep surface from the perimeter;

discarding the first sleep surface; and coupling a second sleep surface to the perimeter.

16. The method of claim 15, wherein the mattress includes a cavity formed by a wall of the perimeter, the step of coupling the first sleep surface including the step of placing the first sleep surface into the cavity, and the step of coupling the second sleep surface including the step of placing the second sleep surface into the cavity.

17. The method of claim 16, further including the step of installing a bladder in the cavity to support the first and the second sleep surfaces.

18. The method of claim 15, wherein the mattress includes a gas outlet to direct gas flow over the first and the second sleep surfaces.

19. The method of claim 15, wherein the step of coupling the first sleep surface includes the step of forming a substantially continuous connection between a periphery of the first sleep surface and the perimeter, and the step of coupling the second sleep surface includes the step of forming a substantially continuous connection between a periphery of the second sleep surface and the perimeter.

20. The method of claim 15, wherein each of the first and the second sleep surfaces includes a plurality of holes configured to permit gas flow through a respective surface of the first and the second sleep surfaces.

21. The method of claim 15, wherein the mattress includes a coupler and the coupling step is performed using the coupler.

22. A method of providing a disposable mattress, including the steps of:

coupling a first sleep surface to a perimeter of a mattress; the mattress including a cavity formed by a wall of the perimeter, the step of coupling the first sleep surface including the step of placing the first sleep surface into the cavity;

permitting a person to contact the first sleep surface;

decoupling the first sleep surface from the perimeter;

discarding the first sleep surface;

coupling a second sleep surface to the perimeter, the step of coupling the second sleep surface including the step of placing the second sleep surface into the cavity; and installing at least two bladders in the cavity to support the first and the second sleep surfaces.

23. The method of claim 22, wherein the bladders are configured to be selectively inflated and deflated to provide rotational therapy to a patient on the mattress.

24. The method of claim 22, wherein each of the coupling steps includes the use of an attachment means.

25. A method of providing a disposable mattress, including the steps of:

coupling a first sleep surface to a perimeter of a mattress; the step of coupling the first sleep surface including the step of attaching the first sleep surface to the perimeter at a location below an opening formed in the mattress for directing gas flow over the first sleep surface, permitting a person to contact the first sleep surface;

decoupling the first sleep surface from the perimeter;

discarding the first sleep surface; and coupling a second sleep surface to the perimeter, the step of coupling the second sleep surface including the step of attaching the second sleep surface to the perimeter at a location below the opening.

26. The method of claim 25, wherein each of the coupling steps includes the use of an attachment means.

27. A method of maintaining a sanitary condition of a mattress having a gas outlet for directing gas flow toward a person using the mattress, the method including the steps of:

attaching a sleep surface including a first bladder and a second bladder coupled to the first bladder to the mattress at a location that permits gas flow over the sleep surface;

permitting a person to contact the sleep surface;

detaching the sleep surface from the mattress after the person contacts the sleep surface;

discarding the sleep surface; and attaching another sleep surface to the mattress.

28. The method of claim 27, wherein the mattress includes a coupler and the coupling step is performed using the coupler.

29. A method of maintaining a sanitary condition of a mattress including the steps of:

providing a first support structure;

coupling a second support structure including a first bladder and a second bladder coupled to the first bladder to the first support structure, the second support structure being configured to support a person;

detaching the second support structure from the first support structure after the second support structure is used to support a person; and discarding the second support structure.

30. The method of claim 29, wherein the second support structure is made of a resilient material.

31. The method of claim 29, wherein the first support structure includes a coupler and the coupling step is performed using the coupler.

* * * * *